United States Patent [19]

Lockard

[11] Patent Number: 4,485,795

[45] Date of Patent: Dec. 4, 1984

[54] TURBO GAS ATOMIZER

[76] Inventor: Linda L. Lockard, P.O. Box 147, Clinton, Tenn. 37716

[21] Appl. No.: 460,870

[22] Filed: Jan. 25, 1983

[51] Int. Cl.[3] ..... F02M 29/02

[52] U.S. Cl. ..... 123/590; 48/189; 261/84; 261/79 R; 261/78 R

[58] Field of Search ..... 123/592, 590; 48/189.4, 48/189.5; 261/84, 79 R, 78 R

[56] References Cited

U.S. PATENT DOCUMENTS

| | | | |
|---|---|---|---|
| 1,498,859 | 6/1924 | Wekerle | 123/592 |
| 2,659,667 | 11/1953 | Bosdet | 123/592 |
| 3,615,296 | 10/1971 | Guarnaschelli | 123/592 |
| 4,153,028 | 5/1979 | Kumm et al. | 123/592 |

FOREIGN PATENT DOCUMENTS

| | | | |
|---|---|---|---|
| 693847 | 11/1930 | France | 123/592 |
| 712136 | 9/1931 | France | 123/592 |
| 345729 | 4/1931 | United Kingdom | 123/592 |

*Primary Examiner*—Ethel R. Cross
*Attorney, Agent, or Firm*—Frank P. Cyr

[57] ABSTRACT

A fuel atomizer adapted to be mounted between the carburetor and intake manifold of an internal combustion engine. The atomizer comprises a housing having mounted therein an impeller with blades having their leading edges disposed at a 45° angle with respect to the horizontal plane of rotation of the impeller. Rotation of the impeller will effect a break up of the larger fuel droplets and to then mix with the incoming air. The impeller is provided with a specially designed spindle journalled for rotation in specially designed spindle bearings to thus insure a smooth operation of the impeller. The housing is also provided with a network of interconnected bars at the outlet end of the housing to effect a still further atomization of the air/fuel mixture as it leaves the housing responsive to the suction created in the intake manifold of the internal combustion engine.

3 Claims, 4 Drawing Figures

TURBO GAS ATOMIZER

BACKGROUND OF THE INVENTION

The invention relates to new and useful improvements in rotary impellers for assisting in the atomization of liquid fuel and air mixtures normally used in the carburetion systems of automotive or other internal combustion engines.

It is well known that if the air/fuel mixture can be mixed intimately by the breaking up of the fuel into atomized droplets greater efficiency in the use of the fuel is obtained and many carburetion systems have been devised to accomplish this purpose.

It is also known that if greater turbulence can be obtained of the atomized mixture, then an even better atomization and intimate mixture can be obtained.

The present invention overcomes certain disadvantages inherent in prior art devices employed in the atomization of a fuel mixture by providing an impeller with blades which are disposed at a desired angle and is caused to rotate in specially formed bearing blocks for the pivot pin on which the blade is mounted for rotation.

The principal object and essence of the invention is therefore to provide a device of the character herewithin described which improves the atomization of the air/fuel mixture used in carburetion.

Another object of the invention is to provide a device of the character herewithin described which can be used in single or multiple barrel carburetion systems, it only being necessary to increase the number of impeller blades used.

A yet further object of the invention is to provide a device of the character herewithin described which is simple in construction, economical in manufacture and otherwise well suited to the purposes for which it is designed.

For further comprehension of the invention, and of the objects and advantages thereof, reference will be had to the following description and accompanying drawing and to the appended claims in which the various novel features of the invention are more particularly set forth.

DESCRIPTION OF THE PREFERRED EMBODIMENT

Proceeding therefore to describe the invention in detail, it should be pointed out that although only a single down-draft carburetion system is shown, nevertheless, the device can be used in multiple barrelled carburetion systems.

Figure 1:
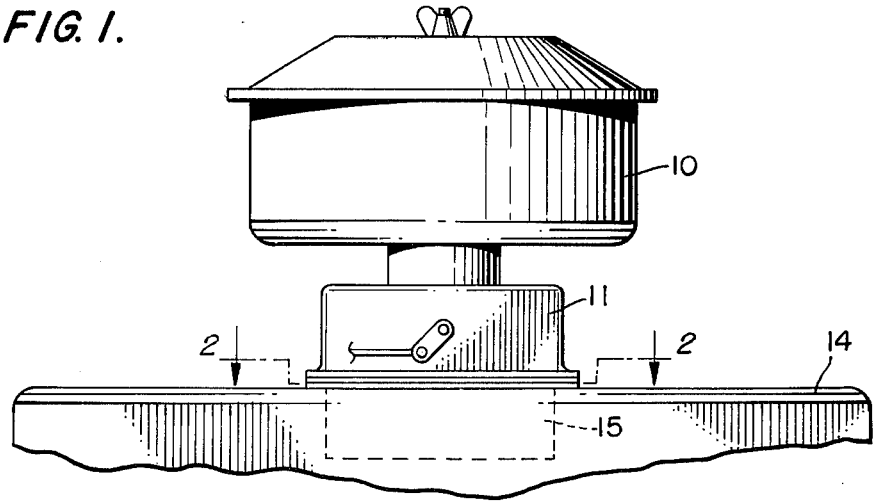
FIG. 1 is a front elevation partially schematic of a carburetion system utilizing the inventive concept of the present invention.
Figure 4:
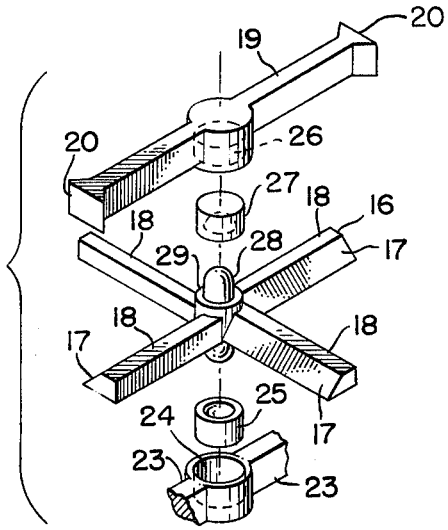
FIG. 4 is an enlarged view showing some of the components of the atomizer of the present invention.

Referring now to the drawings wherein like reference numerals are employed to designate like parts throughout the several views, 10 designates a conventional air cleaner mounted atop of a conventional carburetor 11 having mounted therein a conventional butterfly valve 12 pivotally mounted as at 13 on the downdraft side of the aforesaid carburetor. Schematically shown in FIG. 1 of the drawings is a conventional intake manifold 14 of an internal combustion engine. A housing 15 of circular formation, cup-shaped in external appearance and preferably made of zinc, has mounted for rotation therein an impeller blade 16, also preferably made of zinc. It will be noted as shown in FIG. 4 of the drawings the impeller blade is formed along the leading edge thereof at an angle of approximately 45° as shown at 17 whereas the top portion of the blade lies on a substantially horizontal plane as indicated at 18. It has been determined following a number of tests of the atomizer of the present invention that the 45° angularity provided at the leading edge of the blades, gives a more efficient atomization of the air/fuel mixture.

A crossbar 19 constructed preferably of zinc is provided at each end thereof with a dovetail formation 20 which is adapted to be press fitted into like dovetail formation 21 formed in the wall 22 of the housing 15.

Formed integral with or otherwise secured to the lower portion of the housing 15 is a cross member 23 formed of a suitable metal, preferably zinc and formed in the cross member is a cup-shaped member 24 into which is press fitted a lower spindle bearing 25 made of a metal composition known as Carboloy, a known hard metal compounded by a mixture of about 91% tungsten carbon and 9% cobalt. Forming the bearing from this metallic composition has proven most satisfactory for presenting a bearing having long life endurance during operation of the fuel atomizer of the present invention. A similar cup-shaped opening 26 is formed in cross bar 19 and an upper spindle bearing 27 is press fitted in the cup-shaped opening 26. The upper spindle bearing is also formed from the above described metallic composition known as Carboloy.

Figure 3:
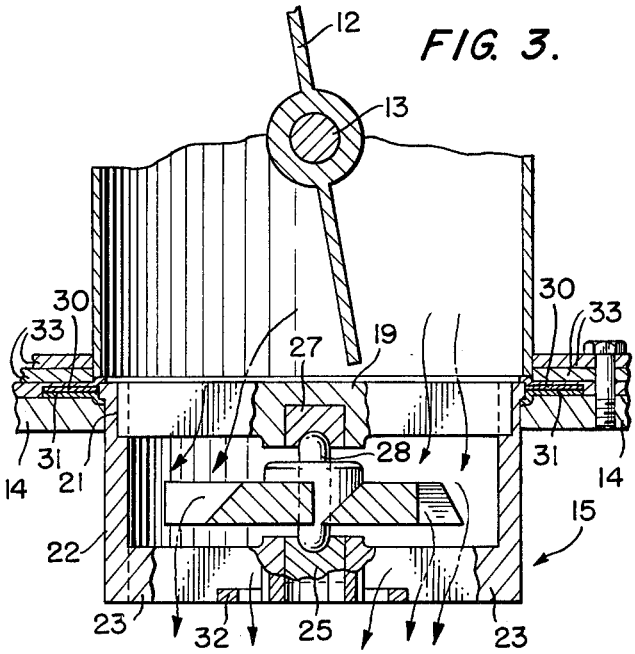
FIG. 3 is an enlarged section taken on lines 3—3 of FIG. 2, looking in the direction of the arrows.

A spindle 28 also formed of Carboloy is press fitted into an opening formed in the impeller hub 29 and when the parts are in assembled relationship as shown in FIG. 3 of the drawings, the rounded ends of the spindle are seated in the like rounded areas formed in both the upper and lower spindle bearing.

A pair of retainer rings 30, 31 are provided at the upper end of the housing 15 with the upper retainer ring 30 overlying the dovetail connection between the cross bar 19 and housing 15 to thus retain the dovetail 20 of cross bar 19 secured within the dovetail 21 formed in the wall 22 of housing 15. The retainer rings 30, 31, preferably made of stainless steel, may be spot-welded or otherwise secured to one another, with the outer edges thereof extending beyond the periphery of the housing thus providing a means whereby the housing and components housed therein may be secured to the intake manifold in a manner to be described hereinafter.

Figure 2:
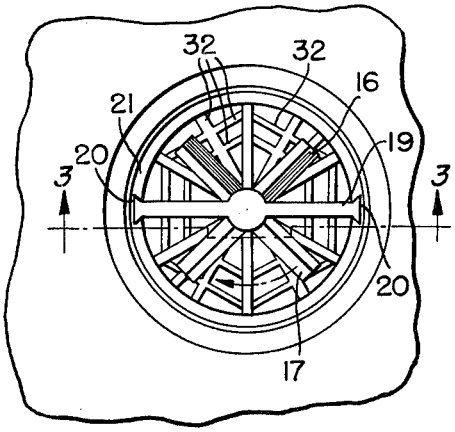
FIG. 2 is a section taken on lines 2—2 of FIG. 1, looking in the direction of the arrows.

Referring now more particularly to FIG. 2 of the drawings, there is shown a network of interconnected bars 32 secured to the lower or exit end of the housing and through which the atomized air/fuel mixture must exit and the bars 32 will serve to further atomize the air/fuel mixture before the mixture is fed to the cylinders for combustion.

To mount the assembled atomizer into the intake manifold of the internal combustion engine, a plurality of gaskets 33 are placed over the edges of the retaining rings 30, 31, and suitable retaining bolts 34 extend therethrough and threadingly engage with the manifold as seen more clearly in FIG. 3 of the drawings.

In operation, the vacuum created in the intake manifold will cause the incoming air/fuel mixture to flow through the aforesaid housing causing rotation of the impeller blade to thus effect a swirling action of the incoming air/fuel mixture. Rotation of the impeller blades will cause a breakdown of the fuel droplets and thus atomize the same. Following the initial atomization of the mixture, as aforesaid, a further atomization of the mixture is occasioned by the flow of the mixture through the network of bars which are provided at the exit end of the housing. In tests conducted on numerous vehicles employing an internal combustion engine equipped with the atomizer of the present invention, an increase in miles per gallon of fuel or anywhere from five to six miles was experienced over similar internal combustion engines operated without the atomizer of the present invention.

While I have illustrated and described the preferred embodiments of my invention, it is to be understood that I do not limit myself to the precise construction herein disclosed and the right is reserved to all changes and modifications coming within the scope of the invention as defined in the appended claims.

Having thus described my invention, what I claim as new and desire to secure by Letters Patent is:

1. A fuel atomizer mounted between the carburetor and intake manifold of an internal combustion engine, the said atomizer adapted to atomize the globlets of fuel emanating from the carburetor and to comingle the same with combustion supporting air also emanating from the said carburetor, said atomizer comprising a cup-shaped housing provided with a pair of retainer rings for securing the said cup-shaped housing between said carburetor and said intake manifold, said housing having an impeller mounted for rotation therein, a cross bar having dovetail sections formed at both ends thereof, said dovetail sections on said cross bar extending into like dovetail sections provided in the upper open ended portion of said cup-shaped housing, a cross member formed integral with the lower portion of the housing, spindle bearings press fitted in said cross bar and cross member, a network of interconnected cross bars secured to and extending across the lower or exit end portion of said housing, an opening formed in said impeller, a spindle press fitted in said opening in said impeller, and seats in the said spindle bearings, said impeller provided with blades the leading edges thereof extending at an angle of 45° with respect to the direction of travel whereupon said impeller will rotate responsive to the vacuum created in the said intake manifold to thereby effect an atomization of the globlets of fuel in said fuel charge and to simultaneously comingle said atomized fuel with the said air before the combined charge of atomized fuel and combustion air is fed to the cylinders of an internal combustion engine.

2. The structure recited in claim 1 wherein said impeller spindle and said bearing spindles are manufactured from a composition comprising 91% tungsten carbide and 9% cobalt.

3. The structure recited in claim 1 wherein a pair of retainer rings are secured to the upper portion of said housing and wherein said rings overlie the said dovetail connection between said rings and said housing.

* * * * *